US008674605B2

(12) United States Patent
Puvanakijjakorn et al.

(10) Patent No.: US 8,674,605 B2
(45) Date of Patent: Mar. 18, 2014

(54) DRIVER CIRCUIT FOR REDUCED FORM FACTOR SOLID STATE LIGHT SOURCE LAMP

(75) Inventors: Voravit Puvanakijjakorn, Beverly, MA (US); Sean Lei, Malden, MA (US); Arunava Dutta, Winchester, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 180 days.

(21) Appl. No.: 13/354,389

(22) Filed: Jan. 20, 2012

(65) Prior Publication Data

US 2012/0286663 A1 Nov. 15, 2012

Related U.S. Application Data

(60) Provisional application No. 61/485,430, filed on May 12, 2011.

(51) Int. Cl.
*H05B 37/00* (2006.01)

(52) U.S. Cl.
USPC ..... 315/85; 315/200 R; 315/247; 315/297

(58) Field of Classification Search
USPC ..... 315/85, 200 R, 246–247, 291, 294, 297, 315/307–308
See application file for complete search history.

(56) References Cited

U.S. PATENT DOCUMENTS

| | | | | |
|---|---|---|---|---|
| 5,982,649 | A * | 11/1999 | Turner | 363/89 |
| 2007/0188114 | A1* | 8/2007 | Lys et al. | 315/308 |
| 2009/0200960 | A1* | 8/2009 | King | 315/291 |
| 2010/0213859 | A1* | 8/2010 | Shteynberg et al. | 315/224 |
| 2010/0328946 | A1 | 12/2010 | Borkar | |
| 2011/0148313 | A1* | 6/2011 | Ramaker | 315/185 R |
| 2011/0193494 | A1* | 8/2011 | Gaknoki et al. | 315/297 |
| 2013/0113375 | A1* | 5/2013 | Leung et al. | 315/85 |

FOREIGN PATENT DOCUMENTS

| | | | |
|---|---|---|---|
| WO | 2005/115058 | A1 | 12/2005 |
| WO | 2011/045371 | A1 | 4/2011 |
| WO | 2011/045372 | A1 | 4/2011 |

OTHER PUBLICATIONS

Supertex Inc., Design Note DN-H05: 56W Off-line, 120VAC with PFC, 160V, 350mA Load, Dimmer Switch Compatible LED Driver, Feb. 26, 2009, pp. 1-19, Supertex inc., Sunnyvale, California, USA.
Matthew Reynolds, AN-1935: LM3445 Off-Line TRIAC Dimmer LED Driver Demo Board, Apr. 14, 2009, pp. 1-8, National Semiconductor, Santa Clara, California, USA.

(Continued)

*Primary Examiner* — Jason M Crawford
(74) *Attorney, Agent, or Firm* — Shaun P. Montana

(57) ABSTRACT

A solid state light source driver circuit, system and method are provided. The driver circuit includes a rectifier circuit, an energy storage element coupled thereto, a current bleeder circuit coupled thereto, and a switch. The rectifier circuit receives AC input and provides unregulated DC voltage. The switch closes to couple some of the unregulated DC voltage to the energy storage element, and opens to transfer energy to drive the light source. A power factor controller circuit provides an output signal to control the switch. The current bleeder circuit provides supply voltage to the power factor controller circuit within a range and maintains a current flow associated with the AC input that exceeds a predetermined threshold. A constant off-time controller circuit provides a switching frequency control signal to the power factor controller circuit. An EMI filter reduces generated EMI noise.

12 Claims, 4 Drawing Sheets

(56) References Cited

OTHER PUBLICATIONS

NXP Semiconductors, SSL2101: SMPS IC for dimmable LED lighting, Rev. 04, Aug. 28, 2009, pp. 1-22, NXP Semiconductors, Eindhoven, The Netherlands.

Tim Sullivan, AN-1995: LM3445 208-277Vac Non-Isolated Evaluation PCB, Oct. 23, 2009, pp. 1-12, National Semiconductor, Santa Clara, California, USA.

National Semiconductor, LM3445 TRIAC Dimmable Offline LED Driver, Sep. 22, 2012, pp. 1-26, National Semiconductor, Santa Clara, California, USA.

Anna-Maria Brosa, International Search Report and Written Opinion of the International Searching Authority, Oct. 5, 2012, pp. 1-12, European Patent Office, Rijswijk, The Netherlands.

* cited by examiner

DRIVER CIRCUIT FOR REDUCED FORM FACTOR SOLID STATE LIGHT SOURCE LAMP

CROSS-REFERENCE TO RELATED APPLICATION

The present application claims priority of U.S. Provisional Application Ser. No. 61/485,430, filed May 12, 2011, the entire contents of which are hereby incorporated by reference.

TECHNICAL FIELD

The present invention relates to lighting, and more specifically, to driver circuits for solid state light source lamps.

BACKGROUND

The development of high-brightness solid state light sources, such as but not limited to light emitting diodes (LEDs) and the like, has led to use of such devices in various lighting fixtures. In general, a solid state light source-based lamp operates in a fundamentally different way than an incandescent, or gas discharge lamp, and therefore may not be connectable to existing lighting fixtures designed for those lamp types. A driver circuit may be used, however, to allow use of an solid state light source-based lamp as a retro-fit for existing lighting fixtures.

The driver circuitry for an solid state light source-based lamp generally converts an alternating current (AC) input, such as a 120V/60 Hz line input or input from a dimmer switch, to a stable direct current (DC) voltage used for driving the solid state light source-based lamp. Such circuitry may incorporate a rectifier for receiving the AC input and a DC-DC converter circuit. The DC-DC converter circuit may receive an unregulated DC output from the rectifier and provide a stable, regulated DC output to the solid state light source-based lamp.

SUMMARY

Conventional techniques for driver circuitry that allows use of an solid state light source-based lamp as a retro-fit for existing lighting fixtures suffer from a variety of issues. One is the ability to fit the required driver circuitry in the limited space available within the form factor of the existing fixture. Existing lighting fixtures generally adhere to one of a number of standards with regard to bulb size, base size, method of attachment, etc. Some lighting fixtures, for example B10 and B11-type chandelier bulbs as well as other types of decorative lamps, provide a relatively small form factor within which the driver circuitry must fit. It can be difficult to fit a driver circuit in this space while meeting other design constraints such as high power factor, low total harmonic distortion and low electromagnetic interference.

A variety of DC-DC converter configurations are well-known. Certain types of known DC-DC converter configurations, such as buck converters, boost converters, buck-boost converters, etc., are generally categorized as switching regulators. These devices include a switch, e.g. a transistor, which is selectively operated to allow energy to be stored in an energy storage device, e.g. an inductor, and then transferred to one or more filter capacitors. The filter capacitor(s) provide a relatively smooth DC output voltage to the load and provide essentially continuous energy to the load between energy storage cycles.

One issue with switching regulator configurations is that they involve a pulsed current draw from the AC power source in a manner that results in less than optimum power factor (PF). The power factor of a system is defined as the ratio of the real power flowing to the load to the apparent power, and is a number between 0 and 1 (or expressed as a percentage, e.g. 0.5 PF=50% PF). Real power is the actual power drawn by the load. Apparent power is the product of the current and voltage applied to the load.

For systems with purely resistive loads, the voltage and current waveforms are in phase, changing polarity at the same instant in each cycle. Such systems have a power factor of 1.0, which is referred to as "unity power factor." Where reactive loads are present, such as with loads including capacitors, inductors, or transformers, energy storage in the load results in a time difference between the current and voltage waveforms. This stored energy returns to the source and is not available to do work at the load. Systems with reactive loads often have less than unity power factor. A circuit with a low power factor will use higher currents to transfer a given quantity of real power than a circuit with a high power factor.

To provide improved power factor, some lamp driver circuit configurations are provided with a power factor controller circuit. The power factor controller circuit may be used, for example, as a controller for controlling operation of the transistor switch in a DC-DC converter configuration such as a fly back converter. In such a configuration, a power factor controller may monitor the rectified AC voltage, the current drawn by the load, and the output voltage to the load, and provide an output control signal to the transistor to switch current to the load having a waveform that substantially matches and is in phase with the rectified AC voltage.

Another issue with switching regulator configurations is that they may introduce harmonic distortion in the form of ripples on the voltage signal returned to the AC power source. These ripples occur at harmonics of the AC line frequency. When these ripples are fed back into the power line, some of the ripples, especially those at third order harmonics of the AC line frequency, may build up voltage levels on the neutral line of power-company-owned three-phase transformers and may damage power-company-owned equipment. Reducing total harmonic distortion (THD) is thus becoming increasingly important as solid state light source-based lamps become more widely used. Indeed, reducing THD and increasing power factor may be important in complying with stricter regulatory requirements such as a California state requirement that THD not exceed 20 percent.

Unfortunately, THD can be exacerbated in an solid state light source-based lamp including a dimmer control circuit. The dimming control circuit may receive line voltage, e.g. from a 120VAC/60 Hz source, and provide a modified output signal to the rectifier for the purpose of controlling the illumination level of the lamp. In one configuration, the dimming control circuit may be a circuit known as a "phase control" dimmer or a "phase-cut" dimmer. In a phase control dimmer, a fraction of the input voltage sine-wave is cut in each period of the waveform either at the leading or trailing edge of the waveform. During the cut-time interval or "dead time" when the voltage is cut, the output of the phase control dimmer may be substantially zero. The residual time interval where the voltage differs from zero is known as the "dimmer conduction time." Both the dimmer conduction time and the dead time are variable, but the time period of the input voltage waveform is constant, e.g. 1/60 second in the United States. As used herein, the "dimmer setting" refers to the ratio of the dimmer conduction time to the time period of the input waveform. The dimmer setting of a phase control dimmer is controllable by a user. In one configuration, the dimmer setting may be varied from about 0.78 to about 0.25. During the dead time at the lowest dimmer setting of the dimmer, the supply voltage to the power factor controller circuit may diminish to a level below its nominal operating range. This may impact performance of the power factor controller circuit, and can lead to an increase in THD as well as reduced power factor.

Embodiments of the present invention provide a solid state light source driver circuit and system that converts AC input such as a 120V/60 Hz input into a current source for a solid state light source-based light source. The circuit may use a single integrated circuit power factor controller to control a switch that couples an unregulated DC voltage provided by a rectifier to an energy storage element such as an inductor. The switch is opened and closed at a frequency resulting in an input power factor that may be set very close to unity. The total harmonic distortion at the input may be very low, and any conducted EMI may be mitigated by the EMI filter components and magnetic shielding of the inductor. The circuit may be disposed on a circuit board, such as a PCB, that fits in a B10 or B1-type chandelier bulb or other type of decorative lamp. Audible noise, caused by vibration of capacitor components, may be reduced by removing portions of the solder mask layer of the PCB beneath those capacitor components. The circuit may thus provide a very high power factor, high efficiency and small size that will work with dimmer switches, including both forward phase and reverse phase dimmers, without flicker in the solid state light source.

In an embodiment, there is provided a driver circuit to drive a solid state light source. The driver circuit includes: a rectifier circuit configured to receive an AC input voltage and provide an unregulated DC voltage; an energy storage element coupled to the rectifier circuit; a switch, wherein the switch is configured to close so as to couple a portion of the unregulated DC voltage to the energy storage element, and wherein the switch is configured to open so as to transfer energy from the energy storage element to provide a DC output voltage to drive the solid state light source; a power factor controller circuit configured to provide an output signal to control the switch; a current bleeder circuit coupled to the rectifier circuit, the current bleeder circuit configured to provide a supply voltage to the power factor controller circuit within a nominal operating range and to maintain a current flow associated with the AC input voltage, wherein the current flow exceeds a predetermined threshold; a constant off-time controller circuit configured to provide a switching frequency control signal to the power factor controller circuit; and an electromagnetic interference (EMI) filter configured to reduce EMI noise generated by the driver circuit.

In a related embodiment, the predetermined threshold may be based on a nominal operating current requirement of a dimmer circuit to reduce flicker of the solid state light source. In another related embodiment, the driver circuit may further include a printed circuit board (PCB) on which the driver circuit may be disposed. In a further related embodiment, the PCB may have a diameter that does not exceed 1.25 inches. In another further related embodiment, the energy storage element and the EMI filter may be disposed on the PCB such that a distance is provided between the energy storage element and the EMI filter that may exceed a preset threshold.

In yet another related embodiment, the energy storage element may be an inductor, and the inductor may be shielded with a ferrite material.

In another embodiment, there is provided a solid state light source lamp assembly. The solid state light source lamp assembly includes: a housing; a solid state light source disposed within the housing; and a driver disposed within the housing, the driver including: a rectifier circuit configured to receive an AC input voltage and provide an unregulated DC voltage; an energy storage element coupled to the rectifier circuit; a switch, wherein the switch is configured to close so as to couple a portion of the unregulated DC voltage to the energy storage element, and wherein the switch is configured to open so as to transfer energy from the energy storage element to provide a DC output voltage to drive the solid state light source; a power factor controller circuit configured to provide an output signal to control the switch; a current bleeder circuit coupled to the rectifier circuit, the current bleeder circuit configured to provide a supply voltage to the power factor controller circuit within a nominal operating range and to maintain a current flow associated with the AC input voltage, wherein the current flow exceeds a predetermined threshold; a constant off-time controller circuit configured to provide a switching frequency control signal to the power factor controller circuit; and an electromagnetic interference (EMI) filter configured to reduce EMI noise generated by the driver circuit.

In a related embodiment, the predetermined threshold may be based on a nominal operating current requirement of a dimmer circuit to reduce flicker of the solid state light source. In another related embodiment, the solid state light source lamp assembly may further include a printed circuit board (PCB) on which the driver circuit may be disposed. In a further related embodiment, the PCB may have a diameter that does not exceed 1.25 inches. In another further related embodiment, the energy storage element and the EMI filter may be disposed on the PCB such that a distance is provided between the energy storage element and the EMI filter that exceeds a preset threshold.

In still another related embodiment, the energy storage element may be an inductor, and the inductor may be shielded with a ferrite material.

In another embodiment, there is provided a method of driving a solid state light source. The method includes: receiving an AC input signal; maintaining a current flow associated with the AC input signal, wherein the current flow exceeds a predetermined threshold; converting the AC input signal into a regulated DC output; controlling a power factor of the regulated DC output using a power factor controller circuit; filtering EMI generated by the converting; and coupling the regulated DC output to the solid state light source.

In a related embodiment, converting may include operating a switch to energize an inductor configured to be coupled to the solid state light source, and wherein controlling the power factor may include controlling the switch.

In a further related embodiment, converting may include operating a switch to energize an inductor configured to be coupled to the solid state light source, wherein the inductor may be shielded with a ferrite material.

In another related embodiment, maintaining may include maintaining a current flow associated with the AC input signal, wherein the current flow exceeds a predetermined threshold based on a nominal operating current requirement of a dimmer circuit to reduce flicker of the solid state light source.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Generally, embodiments provides circuits, systems, and methods for implementing a solid state light source driver for a dimmable solid state light source-based lamp, such as but not limited to an LED-based lamp. The terms "solid state light source-based lamp", "LED-based lamp", and "LED lamp", as used throughout interchangably, refer to any type of lamp and/or lamp system including one or more solid state light sources, whether LEDs, organic light emitting diodes (OLEDs), polymer light emitting diodes (PLEDs), and the like. Similarly, the terms "solid state light source driver", "solid state light source driver circuit", "LED driver", and "LED driver circuit" as used throughout interchangeably, refer to any circuit and/or circuits and/or electronic components and/or combinations of hardware and software that drive one or more solid state light sources, whether LEDs, organic light emitting diodes (OLEDs), polymer light emitting diodes (PLEDs), and the like. Similarly, the terms "solid state light source" and "LED-based light source" refer to any light source that includes one or more solid state light sources, whether LEDs, organic light emitting diodes (OLEDs), polymer light emitting diodes (PLEDs), and the like. The dimmable solid state light source-based lamp has a reduced form factor, such as but not limited to the form factor of a B10 or B11 type chandelier bulb or other type of decorative lamp. The driver, which includes a DC-DC converter configured in a buck converter topology, further includes a power factor controller (PFC) circuit, a current bleeder circuit and a constant off-time controller (COTC) circuit. The current bleeder circuit is configured to maintain a current, drawn from the AC input, above a threshold value to satisfy the current requirements of a dimmer circuit, such as a TRIAC dimmer, and reduce the possibility of flicker. The current bleeder circuit also provides a supply voltage to the COTC circuit and PFC circuit. The COTC circuit enables the PFC circuit to operate at a fixed frequency with increased efficiency and reduced switching loss, which can result in reduced driver size while maintaining low THD and high power factor.

The use of a buck converter topology eliminates the need for a flyback transformer, as would be used in a transformer-based switching regulator. This may further reduce the driver size. A solid state light source driver according to embodiments may also, or alternatively, include an electromagnetic interference (EMI) filter to attenuate EMI conducted noise.

Figure 1:
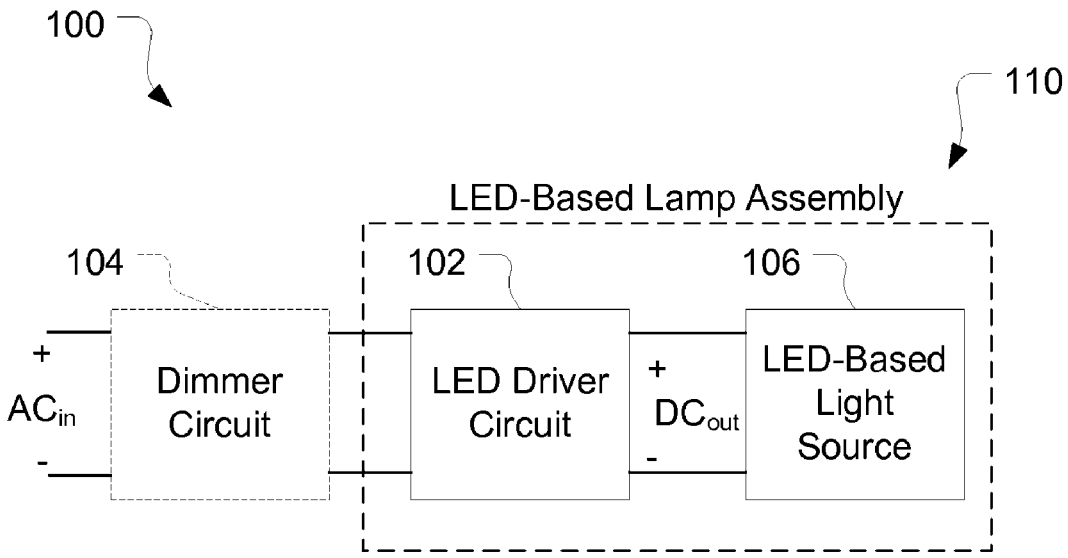
FIG. 1 is a block diagram a system according to embodiments disclosed herein.

Turning now to FIG. 1, there is provided a simplified block diagram of a system 100 according to embodiments described herein. In general, the system 100 includes a light emitting diode (LED) driver circuit 102 for receiving an alternating current (AC) input $AC_{in}$, either directly or through a known dimmer circuit 104, and that provides a regulated direct current (DC) output $DC_{out}$ for driving an LED-based light source 106. The LED-based light source 106 may be configured to occupy a space, such as but not limited to the space occupied by a B10 or B11-type chandelier bulb (i.e., lamp) or other type of decorative lamp. The LED-based light source 106 may include a single LED or multiple LEDs interconnected in series and/or parallel configurations. Although a single LED-based lamp assembly 110 is shown coupled to the dimmer circuit 104, in some embodiments, multiple LED-based lamp assemblies 110 may be coupled to a single dimmer circuit 104. In some embodiments, $AC_{in}$ may be a provided directly from, for example but not limited to, a 120VAC/60 Hz line source. It is to be understood, however, that a system according to embodiments described herein may operate from any type of AC source(s), such as a 220-240 VAC at 50-60 Hz.

In embodiments including the dimmer circuit 104, the dimmer circuit 104 may take any known dimmer circuit configuration, such as but not limited to a standard forward or reverse "phase control" or "phase cut" dimmer provided in a wall switch, the operation of which is well-known. As described above, in a phase control dimmer circuit configuration the dimmer circuit 104 cuts a fraction of the input voltage sine-wave $AC_{in}$ in each period of the waveform to provide an AC input to the LED driver circuit 102 having an associated dimmer setting.

The LED driver circuit 102 may convert the AC input voltage $AC_{in}$ to a regulated DC output voltage $DC_{out}$ with a high power factor, low THD, high efficiency and small size. The LED driver circuit 102 and the LED-based light source 106 may thus be provided within an LED-based lamp assembly 110 as described throughout. The LED-based lamp assembly 110 may provide a convenient retro-fit for existing lighting fixtures configured to energize lamps including non-LED based light sources, e.g. incandescent, fluorescent, and/or gas-discharge sources, and, in particular, lamps with a reduced form factor such as a B10 or B11-type chandelier bulb or other type of decorative lamp. An LED-based lamp assembly 110 as described throughout may be inserted directly into such a lighting fixture to operate on the AC input thereto, and may operate with a known dimmer circuit 104 including forward phase control and reverse phase control dimmer circuits. A lamp including an LED-based light source 106 may provide long life and low power consumption compared to those including non-LED-based light sources.

Figure 2:
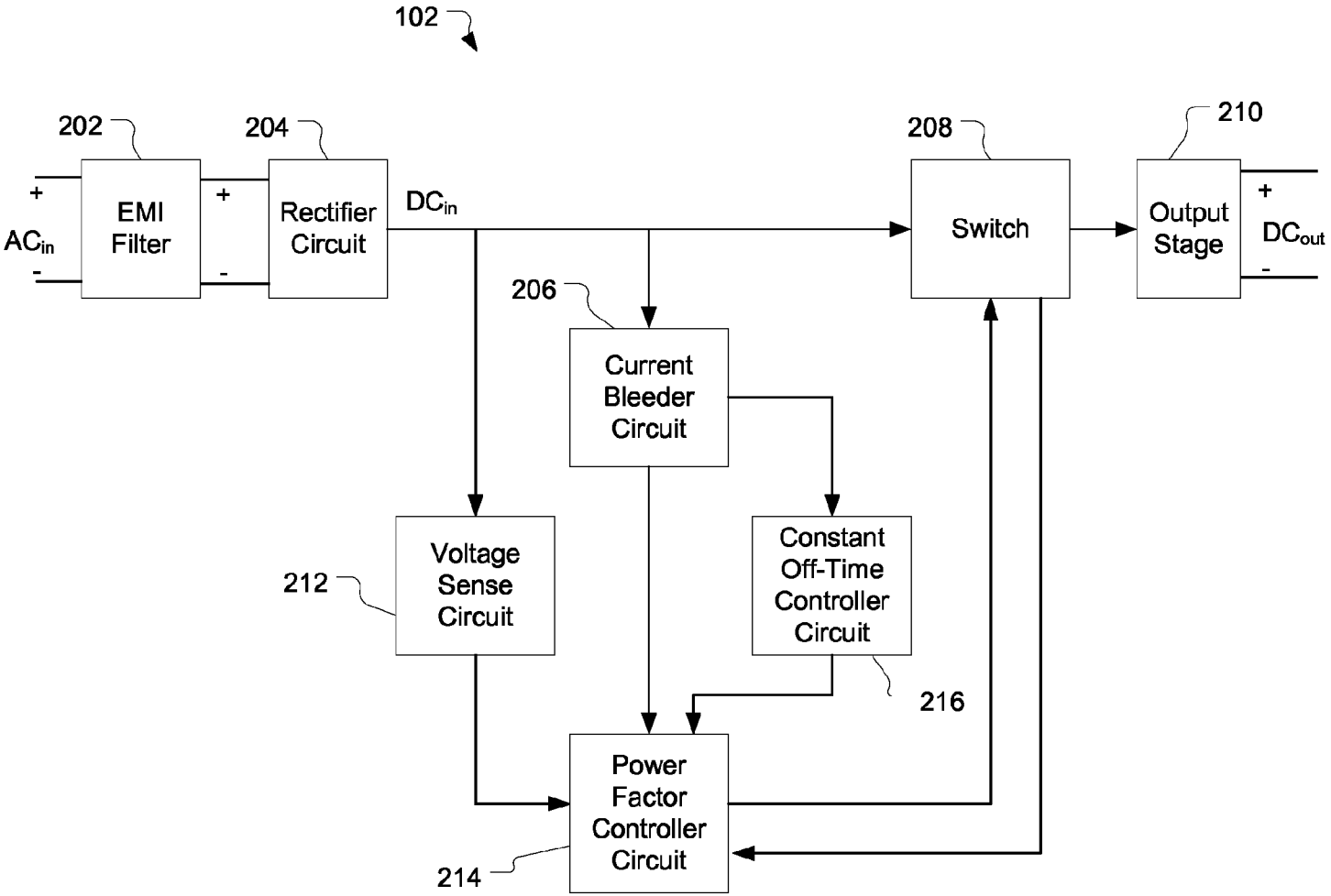
FIG. 2 is a block diagram of a solid state light source driver circuit according to embodiments disclosed herein.

FIG. 2 is a block diagram that conceptually illustrates the functionality of an LED driver circuit 102, as shown in block form in FIG. 1. As shown in FIG. 2, an LED driver circuit 102 includes an electromagnetic interference (EMI) filter 202 (which may, in some embodiments, be absent), a rectifier circuit 204, a current bleeder circuit 206, a switch 208 for coupling the output of the rectifier circuit 204 to an output stage 210, a voltage sense circuit 212, a constant off-time controller (COTC) circuit 216, and a power factor controller (PFC) circuit 214.

In general, the AC input voltage $AC_{in}$ may be coupled to the EMI filter 202 or the rectifier circuit 204, either directly or through a dimmer circuit 104. The EMI filter 202 may be configured to reduce EMI noise and to dampen ringing associated with forward phase control dimmers such as triac-based dimmers. In some embodiments, component values of the EMI filter 202 may be chosen to adjust the phase angle between the input voltage and the input current to achieve lower THD. In some embodiments, component values of the EMI filter 202 may be chosen to reduce an EMI noise resonance peak, for example but not limited to in the range of 150 kHz to 700 kHz and/or substantially 150 kHz to 700 kHz.

The rectifier circuit 204 is configured to rectify $AC_{in}$ to provide an unregulated DC input voltage $DC_{in}$ that follows instantaneous variations in the AC input voltage. A variety of rectifier circuit configurations are well-known in the art. In some embodiments, for example, the rectifier circuit 204 may include a known bridge rectifier. The output of the rectifier circuit 204 is coupled to the output stage 210 through the switch 208 under the control of the PFC circuit 214. The switch 208 may be, but is not limited to being, a known transistor switch, as is commonly used in known switching regulator configurations. In general, the switch 208 controls whether the output stage 210 is coupled to the output of the rectifier circuit 204. The switch 208 therefore controls the amount of energy that is delivered to the output stage 210, and the amount of energy may be adjusted by varying the on-time and off-time of the switch 208. The output stage 210 may include an energy storage element, such as but not limited to an inductor, that is charged by the energy coupled from the switch 208 and discharged through the LED-based light source 106 to drive the light source. The output stage 210 may also include a capacitor to smooth the $DC_{out}$ voltage provided to the LED-based light source 106.

The PFC circuit 214 may, and in some embodiments does, include a known power factor controller configured to provide an output to the switch 208 for controlling the switch 208 in response to a first signal representative of voltage from the rectifier circuit 204, a second signal representative of a desired constant off-time for the power factor controller, and a third signal representative of current flow through the switch 208. The output from the power factor controller controls the switch 208 so that the current to the LED-based light source 106 has a waveform that substantially matches and is in phase with the output of the rectifier circuit 204, thereby providing high power factor and low THD.

Known LED controller integrated circuits (ICs) that may be used as power factor controllers in an LED driver configuration according to embodiments described throughout include known LED controller ICs such as but not limited to model number LM3445 controller presently available from National Semiconductor of Santa Clara, Calif. The LM3445 controller may, for example, be employed as a controller in a buck DC-DC converter implementation. Details of this and related alternative applications of the LM3445 controller are discussed in National Semiconductor's LM3445 data sheet, "LM3445 Triac Dimmable Offline LED Driver," September 2010, which is available at http://www.national.com and is incorporated herein by reference.

In an LED driver circuit 102 according to embodiments described throughout, the current bleeder circuit 206 is configured to maintain a current, drawn from the AC input, above a threshold value, to satisfy the current draw requirements of the dimmer circuit 104. Dimmer circuits, such as a TRIAC dimmer, typically require a minimum current flow throughout the AC voltage waveform cycle. If the current flow drops below this minimum value, the dimmer may temporarily shut off, at least until the current increases, which may cause noticeable flicker of the LED based light source 106. The current bleeder circuit may also provide a supply voltage to the COTC circuit 216 and the PFC circuit 214 to maintain the supply voltage at a nominal operating range during the dead time at the lowest dimmer setting of the dimmer circuit 104. This may avoid an adverse impact on the performance of the COTC circuit 216 and the PFC circuit 214 that could lead to an increase in THD and a reduction of power factor. As used herein, use of the term "nominal" or "nominally" when referring to an amount means a designated or theoretical amount that may vary from the actual amount.

In the LED driver circuit 102, the voltage sense circuit 212 senses the unregulated $DC_{in}$ voltage provided by the rectifier circuit 204 and generates a reference voltage, representative of the unregulated $DC_{in}$ voltage, which is provided to the PFC circuit 214. The reference voltage may be used by the PFC circuit 214 in a comparison with a sensed current through the switch 208 to control the level at which the PFC circuit 214 switches the switch 208 to provide a current waveform to the LED-based light source 106 that substantially matches and is in phase with the output of the rectifier circuit 204. This feature provides a high power factor driver with reduced THD.

The COTC circuit 216 provides a constant off-time signal to the PFC circuit 214, which enables the PFC circuit 214 to operate at a fixed switching frequency with increased efficiency and reduced switching loss, which can result in reduced driver size while maintaining low THD and high power factor. The PFC circuit 214 has an on-time and an off-time. The on-time is the period of time when the PFC circuit 214 causes the switch 208 to be "closed," and thus coupling the rectifier circuit 204 to the output stage 210. The off-time is the period of time when the PFC circuit 214 causes the switch 208 to be "open," and thus de-coupling the rectifier circuit 204 from the output stage 210. The conversion ratio for a buck converter may be defined as: $V_{OUT}/V_{IN}$=on-time/(on-time+off-time). Thus, for a given conversion ratio $V_{OUT}/V_{IN}$ and a given fixed off-time, the on-time is set and the switching frequency, which may be defined as the reciprocal of the sum of the on-time and the off-time, is also fixed.

Figure 3:
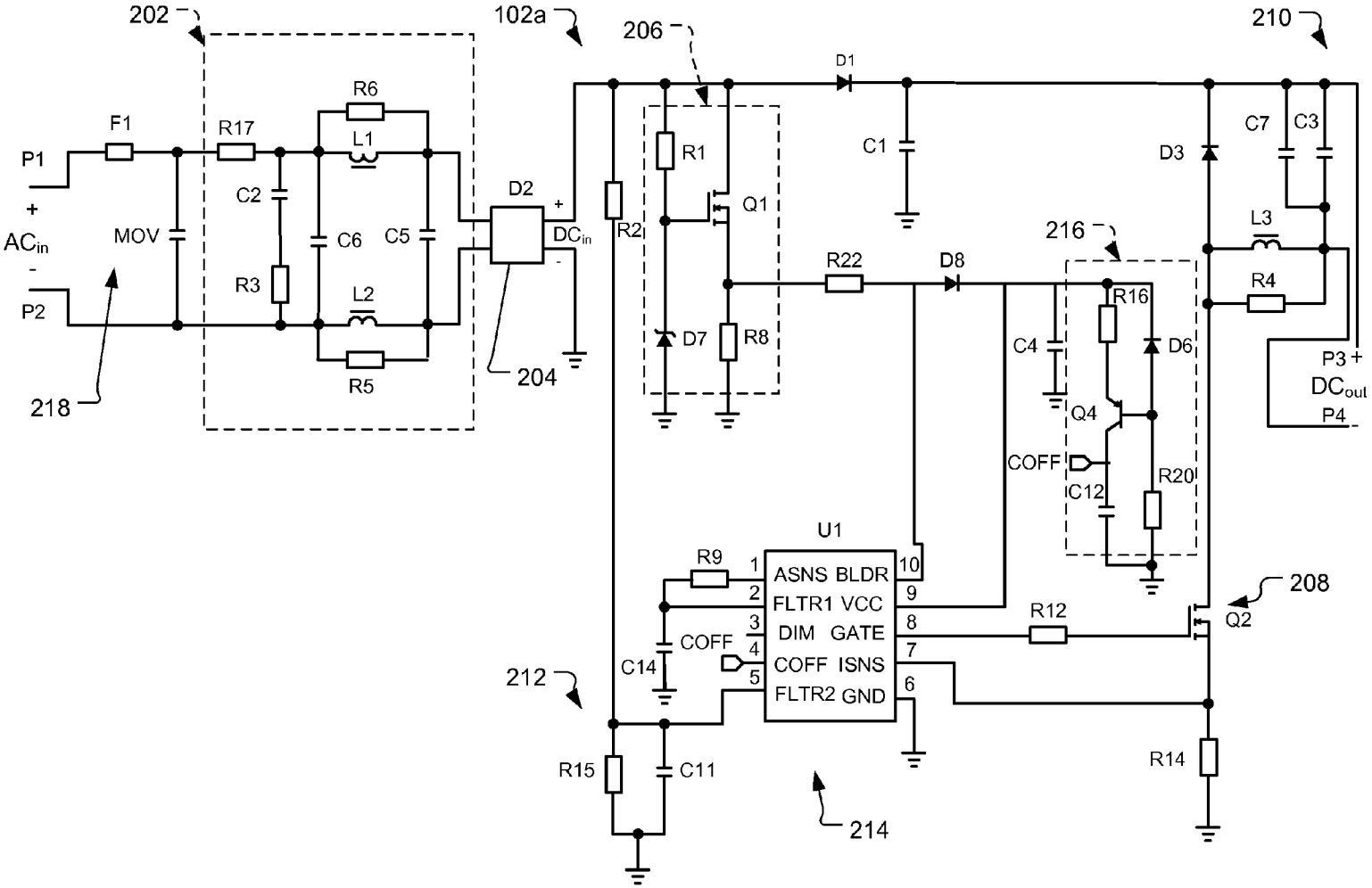
FIG. 3 is a circuit diagram of a solid state light source driver circuit according to embodiments disclosed herein.

FIG. 3 is a schematic diagram illustrating an embodiment of an LED driver circuit 102*a* based on the LED driver circuit 102 shown in FIGS. 1 and 2. The LED driver circuit 102*a* includes an input voltage surge protection circuit 218, an EMI filter 202, a bridge rectifier circuit 204, a current bleeder circuit 206, a switch 208 for coupling the output of the rectifier circuit 204 to an output stage 210, a voltage sense circuit 212, a COTC circuit 216 and a PFC circuit 214. The PFC circuit 214 includes an LM3445 LED controller IC U1, the operation of which is known and described in National Semiconductor's LM3445 data sheet, referred to above. Those of ordinary skill in the art will recognize, however, that other known LED controllers may be used in place of the LM3445 controller shown in the embodiment of FIG. 3.

In operation, the AC input to the circuit $AC_{in}$ is coupled to the rectifier circuit 204 through the surge protection circuit 218 and the EMI filter 202. The surge protection circuit 218 includes a fuse F1 and a metal oxide varistor (MOV), which protect the LED driver circuit 102*a* from input voltage surges. The EMI filter 202 includes inductors L1 and L2, capacitors C2, C5 and C6, and resistors R17, R3, R6 and R5, arranged in a PI network topology. The resistor R17 limits peak and inrush current to the driver circuit 102*a*, which may allow an increased number of LED driver circuits 102*a* to be powered by a single dimmer circuit 104 without damaging the single dimmer circuit 104. The resistor R17 also forms part of the RC filter network that reduces EMI conducted noise. The component values of the EMI filter 202 may be chosen to reduce an EMI noise resonance peak in the approximate range of 150 kHz to 700 kHz. The EMI filter 202 may enable the LED driver circuit 102*a* to comply with FCC Part 15 Class B EMI limitation requirements.

The rectifier circuit 204 includes a known bridge rectifier. The rectifier circuit 204 rectifies the AC input to provide a rectified unregulated DC voltage $DC_{in}$. The output of the rectifier circuit $DC_{in}$ is coupled to the inductor L3 and the capacitors C7 and C3 of the output stage 210 through the diode D1, which acts to block reverse current flow and suppress voltage surges that may be created by the switch 208. The capacitor C1 provides additional EMI noise reduction along this coupling path.

The switch 208 (also referred to in connection with FIG. 3 as the switch Q2) controls whether the output stage 210 is coupled to the output of the rectifier circuit 204. When the gate drive of the switch Q2 is on, the switch Q2 is in a conducting state and current flows from the rectifier circuit 204 through the output stage 210, providing power to the LED-based light source 106 and energizing the inductor L3 that serves as an energy storage element. When the gate drive of the switch Q2 is off, the switch Q2 is in a non-conducting state and the rectifier circuit 204 is de-coupled from the output stage 210. While in this non-conducting state, current flows from the discharging inductor L3 through the diode D3 to provide power to the LED-based light source 106. The capacitors C3 and C7 reduce noise and ripple current to the LED-based light source 106.

In some embodiments, the inductor L3 may be shielded to reduce magnetic field radiation and to reduce interaction between the inductor and a housing of the lamp/lamp assembly/lamp system, which may be metallic. The shielding may comprise a ferrite material with suitable characteristics for reducing radiated magnetic fields.

The gate drive for the switch Q2 is provided by the LED controller IC U1. In general, the LED controller IC U1 uses a voltage representative of the output of the rectifier circuit 204 $DC_{in}$ as a reference to control the level at which the LED controller IC U1 switches the switch Q2 on and off using the gate drive output coupled to the gate of Q2 through R12. This feature allows a very high power factor driver. The switching frequency is determined in part by the COTC circuit 216, which is coupled to a COFF input of the LED controller IC U1, in combination with a representation of the LED driver circuit output current as sensed by the resistor R14 and coupled to an ISNS input of the LED controller IC U1.

In particular, a portion of the $DC_{in}$ voltage is coupled to a FLTR2 input of the LED controller IC U1 to provide a reference voltage to the LED controller IC U1 representative of the unregulated DC voltage $DC_{in}$. The FLTR2 input is coupled between the resistors R2 and R15. Selection of the values of the resistors R2 and R15 allows for a tradeoff between ripple and power factor correction in the output voltage $DC_{out}$ established by the LED controller IC U1. The LED controller IC U1 compares this reference voltage to the voltage representative of the current sense at the ISNS input, and when the two are substantially equal the LED controller IC U1 turns off the gate drive to the switch Q2 for the constant off time as determined by the COTC circuit 216. Thus, the LED controller IC U1 functions as a power factor controller and provides a current waveform to the LED-based light source 106 that substantially matches and is in phase with the output of the rectifier circuit 204 to provide a driver with increased power factor and reduced THD.

Supply voltage is supplied to a supply voltage input Vcc of the LED controller IC U1 through the current bleeder circuit 206. This configuration may ensure that the supply voltage is maintained at a nominal operating range, including through the duration of the dead time associated with the lowest dimmer setting of the dimmer circuit 104, since the bleeder circuit 206 maintains a current draw from the AC input above a threshold value to satisfy the current requirements of the dimmer circuit 104. The bleeder circuit 206 includes a resistor R1, a zener diode D7, and a transistor Q1 in a series pass regulator configuration, which translates the unregulated DC voltage $DC_{in}$ to a level that can be sensed by the LED controller IC U1 at a BLDR input. The resistor R8 bleeds charge from any stray capacitance that may be present in the circuit and provides the current path for the threshold current draw requirement associated with the dimmer circuit 104. The diode capacitor network D8 and C4 maintain the LED controller IC U1 supply voltage Vcc at a nominal operating level when the voltage at the BLDR input decreases.

In an LED driver circuit 102 as described herein, the circuit components may be disposed on a printed circuit board (PCB) in a manner that allows the PCB to be deployed in a lighting fixture of reduced size, such as but not limited to a B10 or B11 type chandelier bulb or other type of decorative lamp. A B10 or B11-type chandelier bulb may include a generally circular housing having a nominal diameter of 1.25 inches and 1.375 inches, respectively, at the widest point. The PCB may therefore have a diameter of less than 1.25 inches to fit within the housing.

In some embodiments, the components may be positioned such that the EMI filter 202 and the output stage 210 are physically separated by an increased distance to further reduce EMI emission. In some embodiments, the PCB may have a solder mask layer and portions of the solder mask beneath ceramic capacitors, such as the capacitors C1, C2 and C5 shown in FIG. 3, may be removed to reduce audible noise caused by vibration of the capacitors against the underlying solder mask. Alternatively, an entire section of the PCB beneath a capacitor may be removed.

A driver circuit 102 may be configured for operation with a variety of input voltages based on appropriate selection of various circuit components thereof. Table 1 below identifies one example of circuit components useful in configuring the LED driver circuit 102*a* illustrated in FIG. 3 for operation with a 120V RMS/60 Hz AC input signal (resistor values in ohms):

TABLE 1

| Component | Descriptor/Value |
|---|---|
| ACin | 120 VAC/60 Hz |
| C1 | 68 nF |
| C2 | 68 nF |
| C3 | Open circuit |
| C4 | 22 uF |
| C5 | 68 nF |
| C6 | Open circuit |
| C7 | 22 uF |
| C11 | 2.2 nF |
| C12 | 330 pF |
| C14 | 470 nF |
| D1 | 200 V - 1 A |
| D2 | 600 V - 0.5 A |
| D3 | 200 V - 1 A |
| D6 | 5.1 V |
| D7 | 12 V |
| D8 | 200 V - 0.25 A |
| DCout | LED connection |
| F1 | 5 A |
| L1 | 5.6 mH |
| L2 | 5.6 mH |
| L3 | 1.0 mH |
| MOV | 470 V |
| Q1 | 240 V - 0.26 A |
| Q2 | 600 V - 1 A |
| Q4 | 40 V - 0.2 A |
| R1 | 390K |
| R2 | 620K |
| R3 | 49.9 |
| R4 | Open circuit |
| R5 | 10K |
| R6 | 10K |
| R8 | 49.9K |
| R9 | 100K |
| R12 | 4.7 |
| R14 | 1.87 |
| R15 | 3.48K |
| R16 | 215K |
| R17 | 24.9 |
| R20 | 30.1K |
| R22 | 40.2 |
| U1 | LM3445 |

In some embodiments, the driver circuit 102*a* has an input power of 3.17 Watts at an input voltage of 120 V (RMS), with an input current of 29.05 mA (RMS), a power factor of 0.91, an input current THD of 19.07%; an output voltage of 11.33 VDC, an output current of 201.68 mA DC, and an efficiency of 74.05%.

Figure 4:
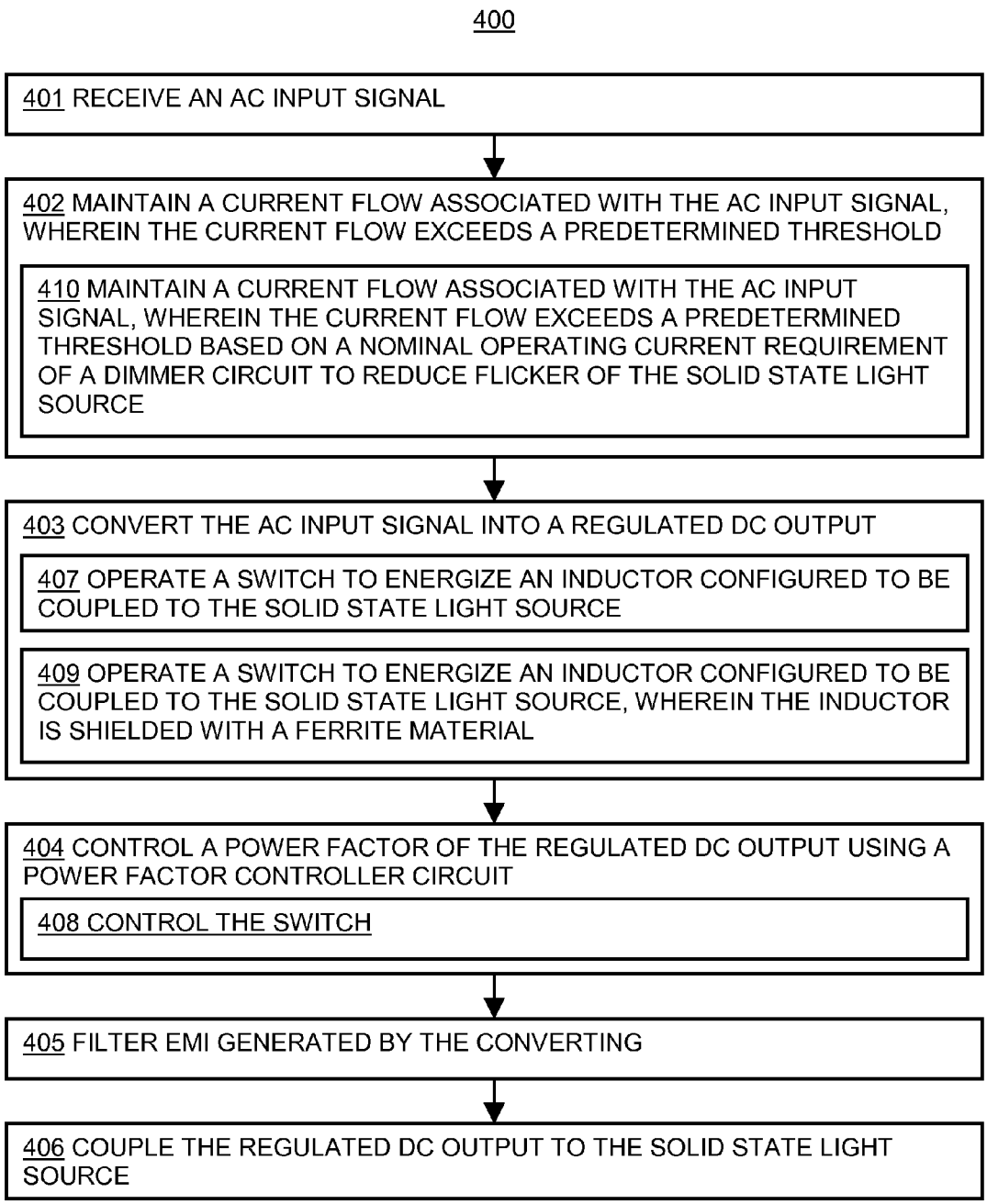
FIG. 4 is a block flow diagram of a method according to embodiments disclosed herein.

FIG. 4 is a block flow diagram of a method 400 for driving an LED-based light source. It will be appreciated by those of ordinary skill in the art that unless otherwise indicated herein, the particular sequence of steps described is illustrative only and may be varied without departing from the spirit of the invention. Thus, unless otherwise stated, the steps described below are unordered, meaning that, when possible, the steps may be performed in any convenient or desirable order.

First, an AC input signal is received, step 401. Then, a current flow associated with the AC input signal is maintained, step 402, wherein the current flow exceeds a predetermined threshold. In some embodiments, a current flow associated with the AC input signal is maintained, step 410, wherein the current flow exceeds a predetermined threshold based on a nominal operating current requirement of a dimmer circuit to reduce flicker of the solid state light source. The AC input signal is converted into a regulated DC output, step 403. A power factor of the regulated DC output is controlled using a power factor controller circuit, step 404. EMI generated by the converting is filtered, step 405. The regulated DC output is coupled to the solid state light source, step 406.

In some embodiments, when the AC input signal is converted into a regulated DC output, step 403, a switch is operated to energize an inductor configured to be coupled to the solid state light source, step 407, and when a power factor of the regulated DC output is controlled using a power factor controller circuit, step 404, the switch is controlled, step 408.

In some embodiments, when the AC input signal is converted into a regulated DC output, step 403, a switch is operated to energize an inductor configured to be coupled to the solid state light source, wherein the inductor is shielded with a ferrite material, step 409.

As used in any embodiment herein, "circuitry" may comprise, for example, singly or in any combination, hardwired circuitry, programmable circuitry, state machine circuitry, and/or firmware that stores instructions executed by programmable circuitry.

The term "coupled" as used herein refers to any connection, coupling, link or the like by which signals carried by one system element are imparted to the "coupled" element. Such "coupled" devices, or signals and devices, are not necessarily directly connected to one another and may be separated by intermediate components or devices that may manipulate or modify such signals. Likewise, the terms "connected" or "coupled" as used herein in regard to mechanical or physical connections or couplings is a relative term and does not require a direct physical connection.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A driver circuit to drive a solid state light source, comprising:

a rectifier circuit configured to receive an AC input voltage and provide an unregulated DC voltage;

an energy storage element coupled to the rectifier circuit;

a switch, wherein the switch is configured to close so as to couple a portion of the unregulated DC voltage to the energy storage element, and wherein the switch is configured to open so as to transfer energy from the energy storage element to provide a DC output voltage to drive the solid state light source;

a power factor controller circuit configured to provide an output signal to control the switch;

a current bleeder circuit coupled to the rectifier circuit, the current bleeder circuit configured to provide a supply voltage to the power factor controller circuit within a nominal operating range and to maintain a current flow associated with the AC input voltage, wherein the current flow exceeds a predetermined threshold;

a constant off-time controller circuit configured to provide a switching frequency control signal to the power factor controller circuit; and an electromagnetic interference (EMI) filter configured to reduce EMI noise generated by the driver circuit.

2. The driver circuit of claim 1, wherein the predetermined threshold is based on a nominal operating current requirement of a dimmer circuit to reduce flicker of the solid state light source.

3. The driver circuit of claim 1, further comprising a printed circuit board (PCB) on which the driver circuit is disposed.

4. The driver circuit of claim 3, wherein the PCB has a diameter that does not exceed 1.25 inches.

5. The driver circuit of claim 3, wherein the energy storage element and the EMI filter are disposed on the PCB such that a distance is provided between the energy storage element and the EMI filter that exceeds a preset threshold.

6. The driver circuit of claim 1, wherein the energy storage element is an inductor, and wherein the inductor is shielded with a ferrite material.

7. A solid state light source lamp assembly comprising:

a housing;

a solid state light source disposed within the housing; and a driver disposed within the housing, the driver comprising:

a rectifier circuit configured to receive an AC input voltage and provide an unregulated DC voltage;

an energy storage element coupled to the rectifier circuit;

a switch, wherein the switch is configured to close so as to couple a portion of the unregulated DC voltage to the energy storage element, and wherein the switch is configured to open so as to transfer energy from the energy storage element to provide a DC output voltage to drive the solid state light source;

a power factor controller circuit configured to provide an output signal to control the switch;

a current bleeder circuit coupled to the rectifier circuit, the current bleeder circuit configured to provide a supply voltage to the power factor controller circuit within a nominal operating range and to maintain a current flow associated with the AC input voltage, wherein the current flow exceeds a predetermined threshold;

a constant off-time controller circuit configured to provide a switching frequency control signal to the power factor controller circuit; and an electromagnetic interference (EMI) filter configured to reduce EMI noise generated by the driver circuit.

8. The solid state light source lamp assembly of claim 7, wherein the predetermined threshold is based on a nominal operating current requirement of a dimmer circuit to reduce flicker of the solid state light source.

9. The solid state light source lamp assembly of claim 7, further comprising a printed circuit board (PCB) on which the driver circuit is disposed.

10. The solid state light source lamp assembly of claim 9, wherein the PCB has a diameter that does not exceed 1.25 inches.

11. The solid state light source lamp assembly of claim 9, wherein the energy storage element and the EMI filter are disposed on the PCB such that a distance is provided between the energy storage element and the EMI filter that exceeds a preset threshold.

12. The solid state light source lamp assembly of claim 7, wherein the energy storage element is an inductor, and wherein the inductor is shielded with a ferrite material.

* * * * *